US010371495B2

(12) United States Patent
Kahana

(10) Patent No.: US 10,371,495 B2
(45) Date of Patent: Aug. 6, 2019

(54) REACTION CONTROL SYSTEM

(71) Applicant: ISRAEL AEROSPACE INDUSTRIES LTD., Lod (IL)

(72) Inventor: Alon Kahana, Hod Hasharon (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 16 days.

(21) Appl. No.: 15/359,295

(22) Filed: Nov. 22, 2016

(65) Prior Publication Data

US 2017/0153097 A1 Jun. 1, 2017

(30) Foreign Application Priority Data

Nov. 29, 2015 (IL) ..... 242827

(51) Int. Cl.
*F42B 15/36* (2006.01)
*F42B 10/66* (2006.01)
*F42B 15/00* (2006.01)

(52) U.S. Cl.
CPC ..... *F42B 15/36* (2013.01); *F42B 10/661* (2013.01)

(58) Field of Classification Search
CPC ..... F42B 15/36; F42B 10/661; F42B 10/663; F41F 3/06
See application file for complete search history.

(56) References Cited

U.S. PATENT DOCUMENTS 4,364,530 A 12/1982 Ripley-Lottee et al.
4,844,380 A * 7/1989 Peoples et al. ..... F42B 15/36 244/3.22
5,657,947 A * 8/1997 Mayersak ..... F42B 10/663 244/3.19
6,178,741 B1 * 1/2001 Nelson ..... F42B 10/661 244/3.22
6,254,031 B1 * 7/2001 Mayersak ..... F42B 10/663 102/384
6,347,763 B1 * 2/2002 Harkins ..... F42B 10/661 244/3.15
6,695,251 B2 2/2004 Rodden et al.
(Continued)

FOREIGN PATENT DOCUMENTS

DE 2012793 10/1971
DE 10236987 A1 * 3/2004 ..... F42B 10/661
(Continued)

OTHER PUBLICATIONS

T. Drescher et al., "Rocket Trajectory Correction Using Strap-on Guided Thrusters"; published in the proceedings of the IEEE 1998 Position Location and Navigation Symposium; Cat. No. 98CH36153; pp. 387-394; IEEE, Piscataway, NJ, USA. (Year: 1998).*

*Primary Examiner* — Bernarr E Gregory
(74) *Attorney, Agent, or Firm* — Dorsey & Whitney LLP

(57) ABSTRACT

A reaction control system (RCS) is provided for use with an air vehicle having a nose portion and a center of gravity aft of the nose portion. The RCS includes a belt element configured for selectively securing the RCS to the nose portion, and also includes a plurality of micro-rocket modules affixed to the belt element, each micro-rocket module being configured for being selectively activated to provide corresponding control moments to the air vehicle when secured to the nose portion thereof. A corresponding air vehicle, and a method for modifying an air vehicle, are also provided.

37 Claims, 4 Drawing Sheets

(56) References Cited

U.S. PATENT DOCUMENTS

| | | | | |
|---|---|---|---|---|
| 7,252,270 | B2 * | 8/2007 | Mitzmacher | F41F 3/06 102/377 |
| 7,416,154 | B2 * | 8/2008 | Bittle et al. | F42B 10/661 244/3.22 |
| 7,973,269 | B1 * | 7/2011 | Rastegar | F42B 10/661 244/3.22 |
| 8,242,422 | B2 * | 8/2012 | Olden et al. | F42B 10/661 244/3.1 |
| 2003/0197088 | A1 * | 10/2003 | Folsom | F42B 10/661 244/3.22 |
| 2010/0206195 | A1 * | 8/2010 | Rastegar | F42B 10/661 102/377 |
| 2011/0204177 | A1 * | 8/2011 | Ritchie | F42B 10/661 244/3.1 |

FOREIGN PATENT DOCUMENTS

| | | | | |
|---|---|---|---|---|
| EP | 0994325 | A2 * | 4/2000 | F42B 10/661 |
| EP | 1843124 | A1 * | 10/2007 | F42B 10/661 |

* cited by examiner

REACTION CONTROL SYSTEM

CROSS-REFERENCE TO RELATED APPLICATION(S)

This application claims priority from Israel Patent Application No. 242827 filed on 29 Nov. 2015, the disclosure of which is incorporated herein, in its entirety, by this reference.

TECHNOLOGICAL FIELD

The presently disclosed subject matter relates to air vehicles, including UAV's and projectiles, and in particular missiles and rockets, in particular that are maneuverable at least after launch.

BACKGROUND ART

References considered to be relevant as background to the presently disclosed subject matter are listed below:

U.S. Pat. No. 4,364,530

U.S. Pat. No. 6,695,251

Acknowledgement of the above references herein is not to be inferred as meaning that these are in any way relevant to the patentability of the presently disclosed subject matter.

BACKGROUND

In one class of conventional missiles, the missiles are launched vertically and fly along a generally ballistic trajectory to a target, reaching a significant height at apogee. In another class of missiles that are launched in a generally vertical orientation, the missiles are instead capable of swinging shortly after launch to attain a desired orientation between vertical and horizontal to continue to target at a significantly lower altitude than would otherwise be the case.

For example, and by way of non-limiting example, U.S. Pat. No. 4,364,530 discloses a modular, apogee-control package which can be added to existing missiles, and which will limit the apogee of the missile trajectory by implementation of thrust vector control (TVC). The package comprises a boost guidance unit, a solid rocket propellant motor, and jet vane TVC.

GENERAL DESCRIPTION

According to a first aspect of the presently disclosed subject matter there is provided a reaction control system (RCS) for use with an air vehicle having a nose portion and a center of gravity aft of the nose portion, the RCS comprising:

- a belt element configured for selectively securing the RCS to the nose portion;
- a plurality of micro-rocket modules affixed to the belt element, each said micro-rocket module being configured for being selectively activated to provide corresponding control moments to the air vehicle when secured to the nose portion thereof.

For example, the air vehicle includes a flight computer for controlling a trajectory of the air vehicle, and the RCS comprises:

- an RCS controller operatively connected to, and configured for controlling activation of, each said micro-rocket module; and

- a communications module operatively connected to said RCS controller and configured for providing a communication link between the RCS and the flight computer and for receiving operation commands therefrom for selectively activating each said micro-rocket module via said RCS controller.

Alternatively, for example, the RCS comprises:

- an RCS controller operatively connected to, and configured for controlling activation of, each said micro-rocket module;
- an inertial navigation system operatively coupled to said RCS controller;
- the RCS being operative to control activation of each said micro-rocket module responsive to navigational data provided by said inertial navigation system.

Additionally or alternatively, the air vehicle includes a maximum diameter of the air vehicle defined aft of the nose portion, the nose portion having a nose portion diameter smaller than the maximum diameter, wherein when secured to the nose portion the RCS is within a cylindrical envelope not exceeding the maximum diameter.

Additionally or alternatively, the air vehicle includes a maximum longitudinal length of the air vehicle, wherein when secured to the air vehicle the RCS is within the maximum longitudinal length of the air vehicle.

Additionally or alternatively, said belt element is configured for selectively securing circumferentially the RCS to the nose portion. For example, said belt element has an inner-facing surface conformal with a portion of an outer surface of the nose portion onto which said inner facing surface abuts when the RCS is secured to the nose portion.

Additionally or alternatively, the belt element is in the form of an annular band.

Additionally or alternatively, the RCS is further configured for being selectively ejected from the air vehicle. For example, the belt element is in the form of a band including two end portions of said band, and wherein said end portions are initially held together by a securing arrangement to enable the RCS to be secured to the nose portion, and wherein the securing arrangement is configured for being selectively activated to thereby separate said two end portions and allow the RCS to become detached from the air vehicle.

Additionally or alternatively, the RCS comprises four said micro-rocket modules, each said micro-rocket module being affixed to the belt element in equi-spaced relationship with respect to an adjacent said micro-rocket module.

Additionally or alternatively, the RCS is configured for activating at least one said micro-rocket module under predetermined conditions to orient the air vehicle in desired orientation to the horizontal. For example, said predetermined conditions include a predetermined time period after launch of the air vehicle, and/or, said predetermined conditions include a predetermined range from the launch site of the air vehicle. For example, said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; 40° to 50°.

Additionally or alternatively, at least one said micro-rocket module comprises a solid rocket motor or a compressed gas tank coupled to a nozzle.

Additionally or alternatively, the air vehicle is a missile, or a rocket, or a UAV.

According to a second aspect of the presently disclosed subject matter there is provided an air vehicle having a nose portion and a center of gravity aft of the nose portion, and comprising a reaction control system as disclosed herein with respect to the aforementioned first aspect of the presently disclosed subject matter.

Optionally, the air vehicle comprises a propulsion unit for providing a forward thrust to the air vehicle.

According to a third aspect of the presently disclosed subject matter there is provided a method for modifying an air vehicle, comprising:

providing the air vehicle, the air vehicle having a nose portion and a center of gravity aft of the nose portion;

providing a reaction control system (RCS) as disclosed herein with respect to the aforementioned first aspect of the presently disclosed subject matter;

selectively securing the RCS to the nose portion.

For example, the method further comprises selectively activating at least one said micro-rocket module to provide a control moment to the air vehicle under predetermined conditions to orient the air vehicle in a desired orientation to the horizontal. For example, said predetermined conditions include a predetermined time period after launch of the air vehicle, and/or, said predetermined conditions include a predetermined range from the launch site of the air vehicle. For example, said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; 40° to 50°.

Alternatively, for example, the method further comprises selectively activating at least one said micro-rocket module to provide a control moment to the air vehicle under predetermined conditions to counter an undesired moment being externally applied thereto. For example, said predetermined conditions include unfavorable launch conditions. For example, said undesired moment is being applied by wind acting on the air vehicle during launch.

A feature of at least one example of the present disclosed subject matter is that a conventional missile that is originally designed for vertical launch and to follow a general ballistic guided trajectory can be retrofitted in a simple and cost effective manner to instead swing to a desired orientation shortly after take-off, with as minimum or no modification to the missile.

Another feature of at least one example of the present disclosed subject matter is that a conventional rocket that is originally designed for vertical launch and to follow a general ballistic trajectory without guidance can be retrofitted in a simple and cost effective manner to instead swing to a desired orientation shortly after take-off, with as minimum or no modification to the rocket, and thus follow a modified trajectory without guidance.

Another feature of at least one example of the present disclosed subject matter is that an air vehicle thus modified can be operated to have a shorter range than the conventional minimum standard range for the unmodified vehicle.

Another feature of at least one example of the present disclosed subject matter is that an air vehicle thus modified can be launched under launch-limiting conditions (for example, severe wind conditions or unstable launch platform) that could otherwise cause such a launch to be aborted.

Another feature of at least one example of the present disclosed subject matter is that an air vehicle thus modified can be operated to provide a side force or control moment to the air vehicle, which can be used for compensating against undesired forces that may be induced on the air vehicle, for example by atmospheric phenomena.

Another feature of at least one example of the present disclosed subject matter is that the desired change in orientation of the air vehicle can be achieved in a weight saving manner, i.e., once the desired change in orientation is achieved, the reaction control system can be discarded and the air vehicle continues along the desired trajectory without the necessity to carry the weight of the reaction control system.

Another feature of at least one example of the present disclosed subject matter is that the overall length and maximum diameter of the air vehicle (e.g. a missile) is conserved when fitted with the reaction control system, allowing the modified air vehicle (e.g. the modified missile) to be launched from the same silo or launch tube as for the unmodified air vehicle (e.g. the unmodified missile), without the need to modify the silo or launch tube.

Another feature of at least one example of the present disclosed subject matter is that by providing the reaction control system forward of the center of gravity of the air vehicle, this modification can contribute to the longitudinal stability of the air vehicle during launch and until the reaction control system is ejected or otherwise disposed of.

BRIEF DESCRIPTION OF THE DRAWINGS

In order to better understand the subject matter that is disclosed herein and to exemplify how it may be carried out in practice, examples will now be described, by way of non-limiting example only, with reference to the accompanying drawings, in which.

DETAILED DESCRIPTION

Figure 1:
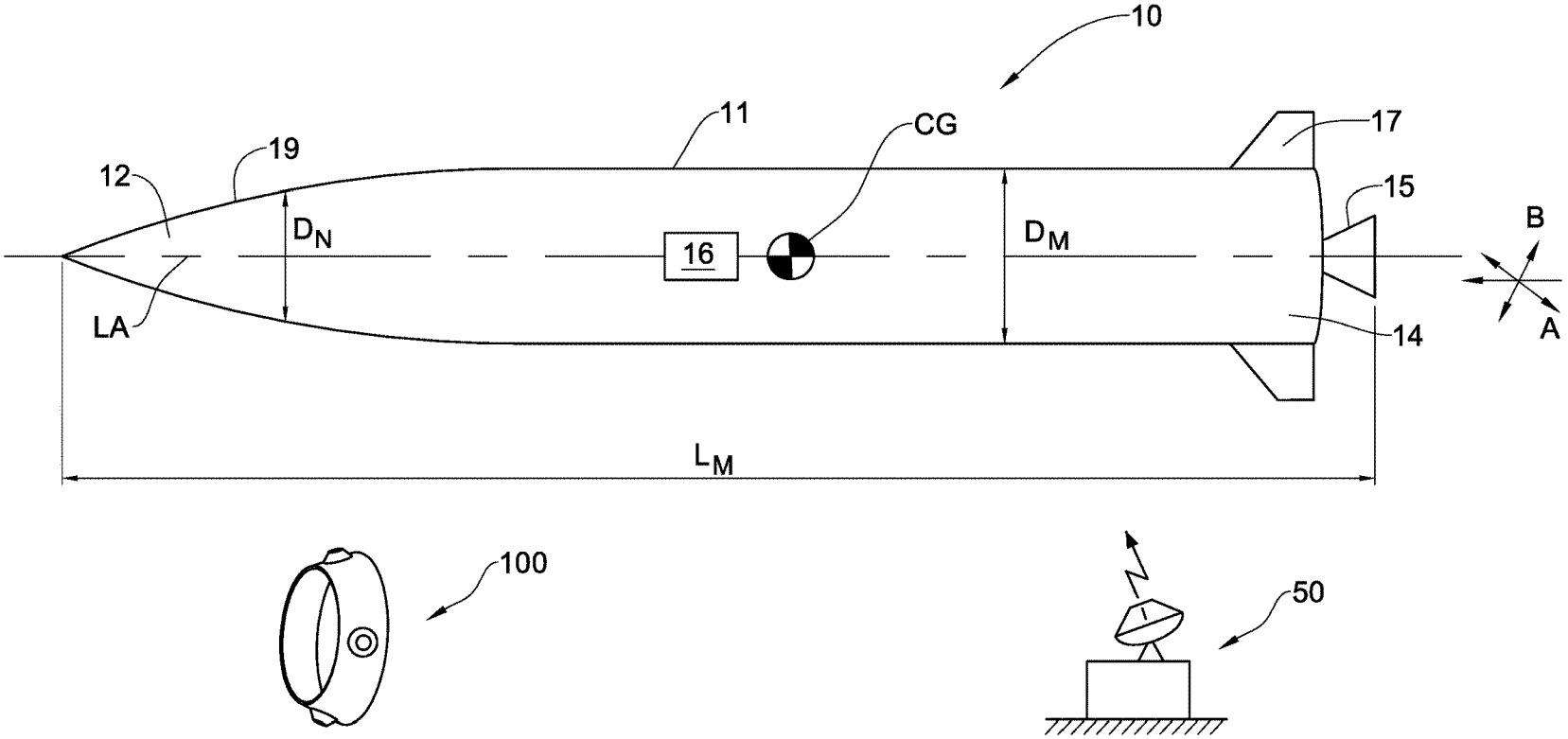
FIG. 1 illustrates in side view an air vehicle for use with the reaction control system according to the present disclosed subject matter.
Figure 3:
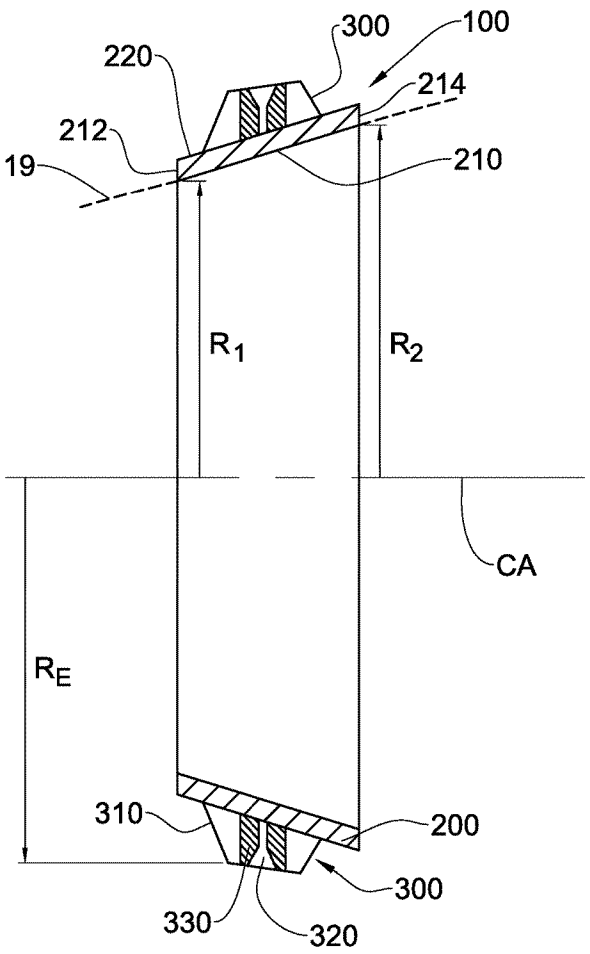
FIG. 3 illustrates in cross-sectional side view the example of FIG. 2.
Figure 2:
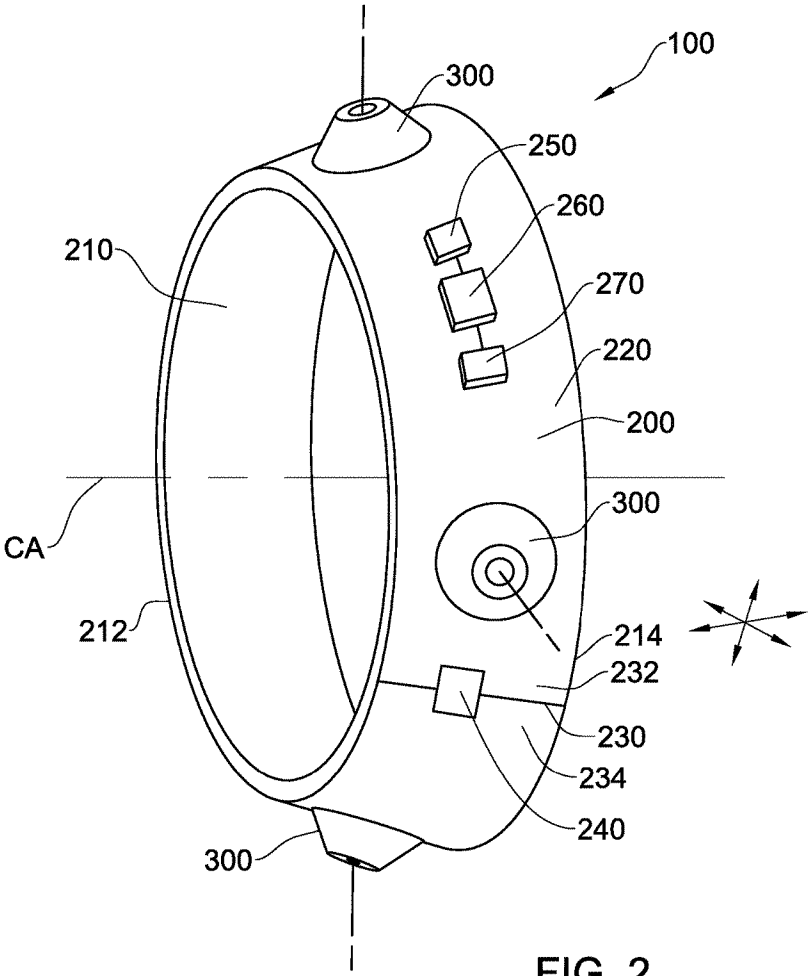
FIG. 2 illustrates in isometric view a first example of the reaction control system according to the present disclosed subject matter.

Referring to FIGS. 1, 2 and 3, an attitude control system (ACS), in particular in the form of a reaction control system (RCS), according to a first example of the presently disclosed subject matter, generally designated 100, is configured for use with an air vehicle, for example the air vehicle of FIG. 1. Herein, reaction control system (RCS) is also interchangeably referred to as a thrust vector control system.

Referring in particular to FIG. 1, an example of such an air vehicle, generally designated with the reference numeral 10, can be any suitable air vehicle which it is desired to modify by selectively affixing the RCS 100 thereto. The air vehicle 10 can include any suitable existing, conventional air vehicle, or any suitable future air vehicle, in the process of being designed or yet to be designed. Furthermore, while the term "air vehicle" is used herein to generally denote a vehicle that is designed to travel in a gaseous fluid medium (for example the atmosphere) while not supported on the ground, herein the term "air vehicle" also includes vehicles which operate in a vacuum (for example in space), or which operate, at least part of the time, in an alternative fluid medium, for example the sea or another body of water.

In this example, the air vehicle 10 is in the form of a missile, having a body 11 defining a longitudinal axis LA, a nose portion 12, an aft portion 14, a propulsion system 15, a flight computer 16, and a maneuvering system 17. While in this example, the body 11 is generally cylindrical, in alternative variations of this example the body can have any other suitable cross-sectional shape, for example oval, elliptical, polygonal (including for example triangular), and/or can be faceted. In this example, the propulsion system 15 comprises one or more rocket engines, which can be of the solid propellant type or liquid propellant type, for example. Additionally or alternatively, the propulsion system 15 can comprise at least one ramjet propulsion system or other jet propulsion systems for example. The maneuvering system 17 in this example comprises controllable fins, though in alternative variations of this example the maneuvering system 17 can include alternative arrangements, for example side thrusters, for example. The flight computer 16 is configured for controlling the trajectory of the air vehicle 10, primarily by controlling the maneuvering system 17, and can include one or more of an inertial navigation system, GPS, communications systems, and so on. The nose portion 12 in this example is aerodynamically contoured, having a hemispherical, conical or ogive shape, and further comprises an external surface 19.

The center of gravity CG of the air vehicle 10 is aft of the nose portion 12.

Referring to FIG. 1, the air vehicle 10 has a maximum diameter $D_M$ defined aft of the nose portion 12, the nose portion 12 thus having a nose portion diameter $D_N$ (where the RCS 100 is to be secured) smaller than the maximum diameter $D_M$. The maximum diameter $D_M$ can optionally exclude the projecting fins of the maneuvering system 17, which can have a stowed position (in which the fins are stowed within the body 11 or wrapped over the body 12, for example) and a deployed position (in which the fins are projecting away from the body 11 and capable of providing maneuvering moments).

Typically, launch of the air vehicle 10 is controlled via a launch controller 50, which can include for example a ground station, and which allows an operator to send launch commands and a flight plan to the air vehicle 10, and optionally also operating commands to the RCS 100.

Figure 4A:
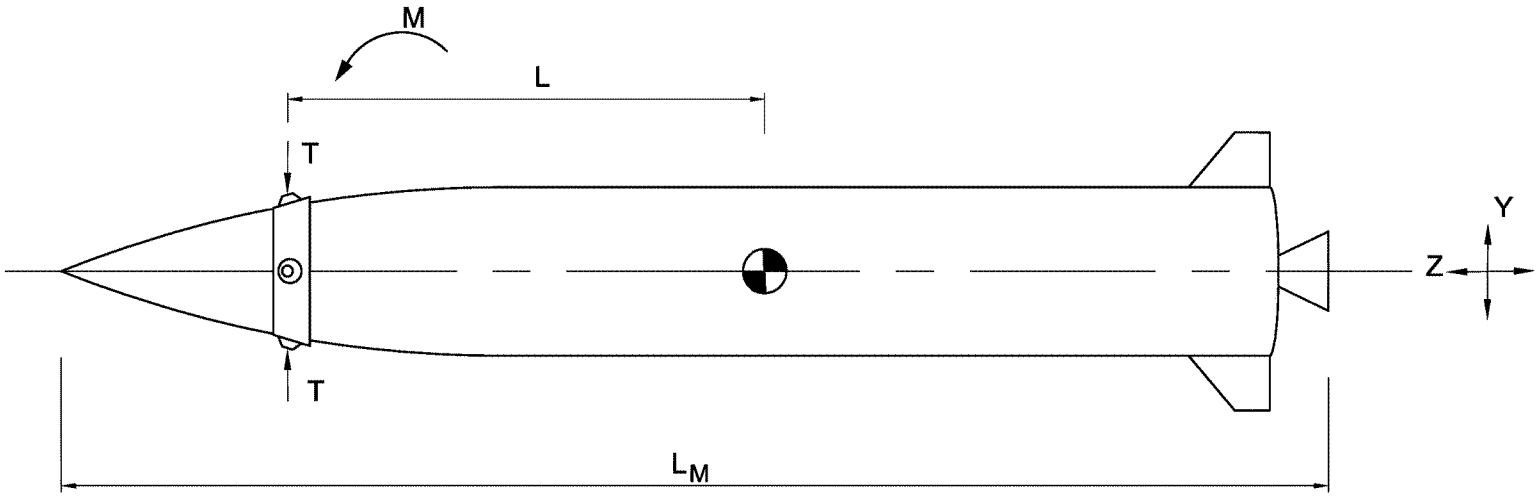
FIG. 4(*a*) and FIG. 4(*b*) illustrate, in side view and in front view respectively, the air vehicle of FIG. 1 with the example of the reaction control system of FIG. 2 affixed thereto.
Figure 4B:
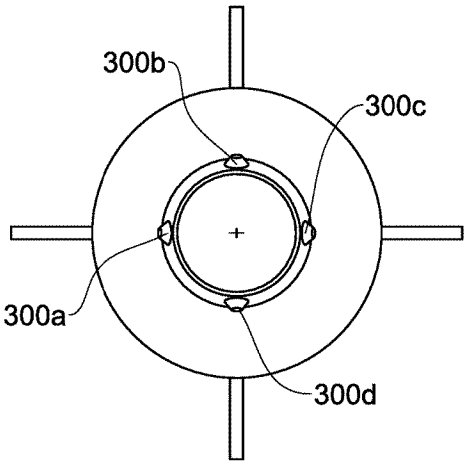

Referring also to FIGS. 4(*a*) and 4(*b*), in this example the RCS 100 is configured for being retrofitted to the air vehicle 10 to provide additional maneuvering capabilities to the air vehicle 10, i.e., in addition to the inherent maneuvering capabilities of the air vehicle 10 (i.e., absent the RCS 100). However, it is to be noted that in at least this example, and referring again to FIG. 1, the air vehicle 10 is designed for full operation even absent the RCS 100. By "full operation" is meant that the air vehicle 10 is designed to complete a flight mission; for example, for such a flight mission the air vehicle 10 (absent the RCS 100) is configured to be launched in a suitable manner (for example in the same manner as the air vehicle 10 with the RCS 100 affixed thereto is launched) and under suitable launch conditions, and then guided to a desired target via the flight computer 16 and the maneuvering system 17. For example, the air vehicle 10 can be launched from a missile firing tube or silo.

Examples of the air vehicle 10 can include, for example, conventional surface to air missiles, or surface to surface missiles, which can be of the short range, medium range or long range type. Examples can include the Arrow, manufactured by IAI, Israel. Other examples of the air vehicle 10 can include, for example attack aircraft, for example some types of UAV, which can be modified with the RCS 100 to enable the aircraft to be launched vertically and fly along lower trajectories. In alternative variations of this example, the air vehicle 10 can include a rocket, which is unguided; in such a case the RCS 100, when affixed to the rocket, can be operated to modify the trajectory thereof in a predictable or semi-predictable manner, even though the modified rocket is not actively guided after launch, particularly after the RCS 100 ceases to operate.

Furthermore, the RCS 100 can be used to reduce the standard minimum range for a missile or rocket, which can be useful in at least some cases when operating such a missile as an attack or defense missile with respect to targets at very short ranges.

Furthermore, by providing the modified air vehicle 10 with a shallow trajectory, the visibility of the air vehicle, for example with respect to enemy radar, can be reduced in at least some cases.

Referring in particular to FIGS. 2 and 3, the RCS 100 comprises a belt element 200 and a plurality of micro-rocket modules 300 affixed to the belt element 200.

The belt element 200 is configured for selectively securing the RCS 100 to the nose portion 12. In at least this example, the belt element 200 is configured for selectively securing circumferentially the RCS 100 to the nose portion 12, in a generally radially abutting relationship. The belt element 200 is in the form of an annular band 201 of suitable load bearing material, having an inner facing surface 210, an outer facing surface 220, a front edge 212 and an aft edge 214. The belt element 200 comprises a central axis CA, which in this example is aligned with the longitudinal axis LA of the air vehicle 10 when the RCS 100 is secured thereto. In an alternative variation of this example, the belt element can be in the form of a cap, for example having a hemispherical, conical or ogive shape corresponding to the shape of the nose portion 12 (or at least a forward part of the nose portion 12), enabling the belt element to fit over the nose portion 12; in such a case the belt element does not comprise a forward edge and is instead closed.

The belt element 200 can be formed as a relatively stiff ring, made from a stiff material—for example some durable plastics or from suitable metals or metal alloys, for example aluminum or titanium. Alternatively, the belt element 200 can be made of non-stiff materials, for example leather, Kevlar, some composites, or other materials.

In this example, and as best seen in FIG. 3, the inner facing surface 210 is conformal with a portion of external surface 19 of the nose portion onto which the RCS 100 is to be secured. Furthermore, in this example, the radius R1 of the front edge 212, taken from central axis CA, is smaller than the radius R2 of the aft edge 214. Thus, the cross-sectional size of the belt element 200 increases along the central axis CA in an aft direction. It is therefore readily apparent that forward acceleration forces of the air vehicle 10 acting on the RCS 100 can serve to wedge and further secure the RCS 100 to the air vehicle 10.

In alternative variations of this example, the belt element can have a uniform cross-sectional shape and/or size along the central axis thereof.

In this example, the belt element 200 is also configured for reversibly securing the RCS 100 to the nose portion 12. For example, the belt element 200 can be configured for initially securing the RCS 100 to the nose portion 12 in any suitable manner, for example via a friction fit with respect thereto. Furthermore, the belt element 200 is also configured for enabling the RCS 100 to be selectively ejected or otherwise removed from the air vehicle 10 once the RCS 100 has completed its task, which will be discussed in further detail below. To facilitate ejection of the RCS 100 from the air vehicle 10, the belt element 200, in this example, is formed with a longitudinal break 230, bordered by two end portions 232 and 234 of the band 201. The two end portions 232 and 234 of the band 201 are held together by an explosive bolt arrangement 240 or any other suitable separation device to provide the load-bearing annular form. When the explosive bolt arrangement 240 is activated, the two end portions 232 and 234 separate, allowing the RCS 100 to fall off the air vehicle 10. Alternatively, the two end portions 232 and 234 of the band 201 can instead overlap circumferentially over one another, and the overlapping portions thereof are initially held together by the explosive bolt arrangement or other suitable separation device, and selectively caused to separate to allow the RCS 100 to fall off the air vehicle 10.

Other suitable separation device can include, for example, non-explosive actuators which are electrically powered and allow for rapid release with low power consumption. Such non-explosive actuators are well known in the art and can include, for example the non-explosive actuators marketed by Eaton.

In this example, there are four micro-rocket modules 300 affixed to the belt element 200, in uniform circumferential distribution with respect thereto. Said differently, each micro-rocket module 300 is affixed to the belt element 200 in equi-spaced relationship with respect to an adjacent micro-rocket module 300.

Thus, in this example, the four micro-rocket modules 300 are in equi-spaced arrangement, such that at least when the RCS 100 is secured to the air vehicle 10 the four micro-rocket modules 300 are in cruciform arrangement, as best seen in FIG. 4(*b*). In this configuration, one pair of opposite-facing micro-rocket modules 300 (designated 300*a*, 300*c* in FIG. 4(*b*)) are aligned along an axis x, while the other pair of opposite-facing micro-rocket modules 300 (designated 300*b*, 300*d* in FIG. 4(*b*)) are aligned along an axis y, wherein axes x and y are mutually orthogonal and also orthogonal to the central axis CA.

While in this example, the x-axis is parallel to a pitch axis A of the air vehicle 10, and the y-axis is parallel to the yaw axis B of the air vehicle 10 (FIG. 1), in alternative variations of this example, other arrangements are possible. For example the x axis and/or the y axis can be angularly displaced from the pitch and yaw axes of the air vehicle when the RCS 100 is secured to the air vehicle 10.

While in this example, the x-axis and the y-axis are coplanar and spaced at a spacing L from the center of gravity CG (FIG. 4(*a*)) when the RCS 100 is secured to the air vehicle 10, in alternative variations of this example, the x-axis can instead be axially spaced from the y-axis (along the central axis CA), for example, and thus each pair of opposite-facing micro-rocket modules 300 can have a different axial spacing with respect to the center of gravity CG.

In alternative variations of this example, instead of four micro-rocket modules 300, a different number of micro-rocket modules 300 can be affixed to the belt element 200—for example: 1, 2, 3, 5, 6, 7, 8, 9, 10, 11, 12 or more that 12 micro-rocket modules 300. For example, in examples in which more than two micro-rocket modules 300 are affixed to the belt element 200, the micro-rocket modules 300 can be uniformly distributed circumferentially over the belt element 200, or at least some micro-rocket modules 300 can be placed in close spacing with one another to form clusters of micro-rocket modules 300, which optionally can then be uniformly distributed circumferentially over the belt element 200.

While in this example the micro-rocket modules 300 are all substantially identical to one another in structure, function and thrust rating, in alternative variations of this example, the micro-rocket modules 300 can be different from one another in one or more of structure, function and thrust rating.

Each one of the micro-rocket modules 300 is configured for being selectively activated to provide a control side thrust T, which in turn provides a corresponding control moment M to the air vehicle 10 when secured to the nose portion 12 thereof via moment arm L (FIG. 4(*a*)). For example, and referring to FIGS. 4(*a*) and 4(*b*): micro-rocket module 300*b* can provide a negative pitch moment; micro-rocket module 300*d* can provide a positive pitch moment; micro-rocket module 300 can provide a negative yaw moment; micro-rocket module 300*a* can provide a positive yaw moment.

The micro-rocket modules 300 can be activated individually, or in groups of two or more micro-rocket modules 300, in any combination, either concurrently or in any desired sequence, to achieve any one of a range of different swing angles (i.e. orientation) and/or thrust levels for the control side thrust T, after activation.

As best seen in FIG. 3, in this example each micro-rocket module 300 is in the form of a solid rocket motor, and comprises an outer casing 310, exhaust nozzle 320 and rocket propellant 330, which in this example is a solid propellant. However, in alternative variations of this example, one or more of the micro-rocket module 300 comprises a compressed gas tank coupled to a nozzle, for example, or other suitable arrangements.

In this example, the micro-rocket modules 300 project radially from the belt element 200 (in particular from the outer facing surface 220), and such that the RCS 100 is confined within a cylindrical envelope of radius $R_E$ (FIG. 3) defined with respect to the central axis CA. In this example, the corresponding diameter ($2*R_E$) of the cylindrical envelope does not exceed the maximum diameter $D_M$ of the air vehicle 10, which for example can thus be fired from an original silo or launch tube designed for the original air vehicle 10. Similarly while the air vehicle 10 has a maximum longitudinal length $L_M$, when secured to the air vehicle the RCS 100 is axially within this maximum longitudinal length $L_M$, and thus allows the air vehicle 10 to be launched, for example from an original silo or launch tube designed for the original air vehicle 10.

In alternative variations of this example, the diameter of the cylindrical envelope can exceed the maximum diameter $D_M$ of the air vehicle 10, and/or, when secured to the air vehicle the RCS 100 is axially outside of the maximum longitudinal length $L_M$. In these or other alternative variations of this example, the micro-rocket modules 300 do not project radially from the belt element 200, and can be flush with or recessed into the outer facing surface 220. In such cases the RCS 100 can still be confined within a corresponding cylindrical envelope of radius $R_E$ (FIG. 3) defined with respect to the central axis CA, and optionally the corresponding diameter ($2*R_E$) of the cylindrical envelope does not exceed the maximum diameter $D_M$ of the air vehicle 10, which for example can thus be fired from a silo designed for the original air vehicle.

It is contemplated that in at least some examples, the RCS 100 is made from relatively lightweight materials, such that the gross weight of the RCS is small relative to the gross weight of the air vehicle 10, and thus affixing the RCS 100 to the nose portion 12 of the air vehicle does not cause any significant longitudinal shift of the position of the center of gravity CG.

In yet other examples, the RCS 100 is made from relatively heavier materials, which, while still allowing the modified air vehicle to lift off and achieve a desired altitude within a desired time after launch (i.e. prior to activation of the RCS 100), also provides added longitudinal stability to the air vehicle, by effectively displacing the position of the center of gravity CG in a forward direction. Since the RCS 100 can be ejected after use, the air vehicle 100 can continue to its target without the weight penalty of the RCS 100.

Israel Military Industries Ltd, Israel, manufactures a variety of examples of custom designed micro-rockets for a variety of rockets, for example the Arrow. In at least some applications of the RCS 100, the micro-rocket modules 300 can be based on at least one such example.

Referring to FIG. 2, the RCS 100 further comprises an RCS controller 260 and a communications module 270. The RCS controller is operatively connected to each micro-rocket module 300, and is configured for controlling activation of each micro-rocket module 300. For example, the RCS controller comprises a microprocessor or other suitable computer system. The position of each micro-rocket module 300 with respect to the RCS 100 is programmed into the RCS controller 260.

The communications module 270 is operatively connected to the RCS controller 260 and is configured for providing a communication link between the RCS 100 and the flight computer 16. The communications module 270 is also configured for receiving operation commands from flight computer 16 for selectively activating each micro-rocket module 300 via said RCS controller 260. In this connection it is to be noted that the air vehicle 10, and in particular the flight computer 16, is configured for enabling communications with the communications module 270, and in some examples also for providing suitable operation commands to the RCS 100 for selectively activating each micro-rocket module 300. It is to be noted that the air vehicle 10, and in particular the flight computer 16, is configured for enabling communications with the launch controller 50, to enable launch commands and flight plan to be uploaded to the flight computer 16 via the launch controller 50.

In at least some examples, and referring to FIG. 2, the RCS 100 further comprises an inertial system 250 for determining the spatial orientation of the RCS 100. For example, the inertial system 250 comprises accelerometers (for example 3-axis accelerometers) and/or gyroscopes (e.g. 3-axis gyroscopes), or any other suitable inertial sensors, for example, MEMS inertial sensors. The inertial system 250 is operatively connected to the RCS controller 260 and/or to the communications module 270.

The inertial system 250 provides spatial data to the RCS controller 260 regarding the spatial orientation of the RCS 100 prior to launch, and thus enables the RCS controller 260 to determine which of the micro-rocket module 300 need to be activated, and for how long, to provide the desired change in the orientation of the air vehicle 10, and further provides spatial data to the RCS controller 260 to then operate the micro-rocket modules 300 to maintain the desired orientation prior to ejecting the RCS 100, for example.

Optionally the RCS controller 260 and the communications module 270, or the RCS controller 260 and the inertial system 250, or the communications module 270 and the inertial system 250, or all three the inertial system 250, the RCS controller 260 and the communications module 270, are provided as an integrated module.

The RCS 100 can be installed on the air vehicle 10 by affixing it thereto. When required to be used, and at least prior to launch of the air vehicle 10, in some examples the communication module 270 is placed in communication with the flight computer 16.

In at least one application of the RCS 100, the RCS 100 provides the task of facilitating changing the orientation of the air vehicle 10, soon after launch, from a generally vertical orientation to a desired orientation, enabling the air vehicle 10 to quickly utilize its forward thrust along the desired trajectory for reaching the target position quickly. For example the aforementioned desired orientation can include a generally horizontal orientation, or any desired angular orientation between vertical and horizontal, for example any desired angular orientation within any one of the following ranges with respect to the horizontal: 0° to 89°; 5° to 85°; 10° to 80°; 15° to 75°; 20° to 70°; 25° to 65°; 30° to 60°; 35° to 55°; 40° to 50°. In some situations, for example where it is wished to convert the air vehicle 10 into a vertically launched cruise missile, the RCS 100 allows minimizing the time to reach the optimum altitude (by being launched vertically).

According to another aspect of the presently disclose subject matter, there are at least three levels of integration of the RCS 100 with respect to the air vehicle 10. These levels of integration are referred to herein as LV1, LV2 and LV3:

Integration Level LV1—in this integration level, the RCS 100 is configured as a stand-alone system that operates completely independently from the air vehicle 10, and thus receives operating instructions directly from the launch control 50 rather than via the air vehicle 10. Correspondingly, the original air vehicle 10 needs to be configured to take account of the operation of the RCS 100. For example, the original air vehicle 10 can be correspondingly modified, typically by modifying the software of the flight computer 16 to receive new launch parameters from the launch control 50 that take account of the operation of the RCS 100 and its impact on the trajectory of the air vehicle 10.

Integration Level LV2—in this integration level, the RCS 100 is configured as a stand-alone system, but configured for interacting with air vehicle 100 in the sense that operating instructions to the RCS 100 are provided by the air vehicle 10 itself, rather than directly from the launch control 50. Correspondingly, the air vehicle 10 needs to be modified, typically by configuring the air vehicle 10 to enable communication between the flight computer 16 and the RCS 100, and to provide suitable operating instructions for operating the RCS 100 based on launch parameters received by flight computer 16 the from the launch control 50. The flight computer 16 is further configured to take account of the operation of the RCS 100 in further controlling the trajectory of the air vehicle 10. In such a case, the air vehicle 10 can be modified to provide the aforementioned communication with the RCS 100, for example by providing a wireless communication module, or umbilical or plug connection with respect to the RCS 100.

Integration Level LV3—in this integration level, the RCS 100 is configured as an integrated sub-system of the air vehicle 100. In such a case, the operating instructions to the RCS 100 are provided by the air vehicle 10 itself, rather than directly from the launch control 50, similar to Integration Level LV2, mutatis mutandis; however, the RCS 100 does not require an inertial system, for example inertial system 250 which can this be omitted, since the spatial data of the air vehicle 10 relating to the orientation thereof can be provided by the air vehicle 10 itself.

Figure 5:
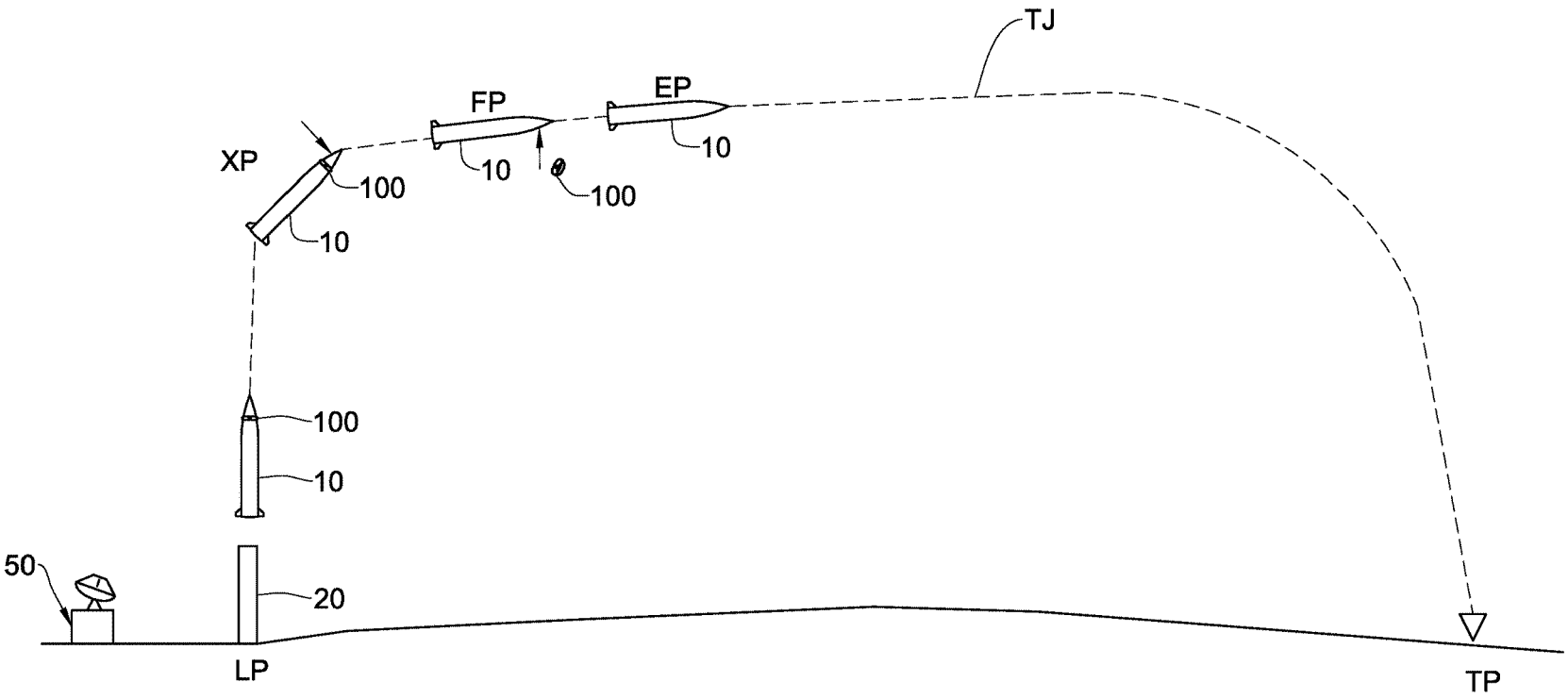
FIG. 5 schematically illustrates an example of operation of the air vehicle of FIGS. 4(*a*) and 4(*b*) according to the present disclosed subject matter.

Referring to FIG. 5, the RCS 100 can be operated to provide the aforementioned task, as follows for example, wherein in this example the RCS 100 is configured according to the first integration level LV1. The RCS 100 is first installed on the air vehicle 10 by affixing it thereto. When required to be used, and at least prior to launch of the air vehicle 10, the communication module 270 is placed in communication with the launch control 50.

The thus-modified the air vehicle 10 is launched vertically at the launch position LP in the normal manner in which the unmodified the air vehicle 10 is designed to be launched, for example using a launch tube or silo 20.

At a predetermined point after launch (for example after a predefined time period or when the air vehicle 10 has attained a predefined altitude), indicated at XP in FIG. 5, the RCS controller 260 (having received suitable operation commands from the launch control 50 via the communication module 270) activates one or more micro-rocket modules 300 to induce at least a pitch moment (and possibly also a yaw moment), in particular a negative pitch moment on the air vehicle 10, to cause the air vehicle 10 to swing and thus pitch nose-down and in the general direction towards the target point TP. When the desired amount of pitch has been attained, for example the air vehicle 10 is now oriented at the desired angle to the horizontal, for example between 20° and 70°, the RCS controller 260 activates one or more micro-rocket modules 300 in order to counter the previously induced negative pitch moment to stop the negative pitch moment from rotating the air vehicle 10 any further in pitch and thus maintain its new attitude, indicated at FP in FIG. 5. Shortly thereafter the RCS 100 can be ejected, indicated at EP in FIG. 5, and the air vehicle 10 is guided to the target point TP along a desired trajectory TJ using the flight computer 16, which is programmed to take into account the operation of the RCS 100 and receives the flight plan from launch controller 50, for example.

In applications where the RCS 100 is configured according to the second integration level LV2, the RCS 100 can be operated to provide the aforementioned task, in a similar manner described above for the first integration level LV1 with reference to FIG. 5, but with the following differences, mutatis mutandis. In this case, when required to be used, and at least prior to launch of the air vehicle 10, the communication module 270 is placed in communication with the flight computer 16. At a certain point after launch (for example after a predefined time period or when the air vehicle 10 has attained a predefined altitude), indicated at XP in FIG. 5, the RCS controller 260 (having received suitable operation commands from the flight computer 16 via the communication module 270) activates one or more micro-rocket modules 300 to provide the desired angle of orientation for the air vehicle 10, which is subsequently controlled by flight computer 16, as before.

In applications where the RCS 100 is configured according to the third integration level LV3, the RCS 100 can be operated to provide the aforementioned task, in a similar manner described above for the second integration level LV2 with reference to FIG. 5, but with the following differences, mutatis mutandis. In applications where the RCS 100 is configured according to first integration level LV1 or according to the second integration level LV2, the RCS 100 determines the general orientation of the air vehicle 10 for example using the inertial system 250, and determines via the RCS controller 260 how to operate the micro-rocket modules 300 to provide the desired angle of orientation for the air vehicle 10. However, where the RCS 100 is configured according to third integration level LV3, the flight computer 16 determines the general orientation of the air vehicle 10 for example using on-board inertial system, and determines how to operate the micro-rocket modules 300 to provide the desired angle of orientation for the air vehicle 10.

In at least one other application of the RCS 100, the RCS 100 provides the task of providing stability to the air vehicle during launch (in addition to or in place of facilitating changing the orientation of the air vehicle 10, soon after launch, from a generally vertical orientation to a desired orientation), for example under unfavorable launch conditions, for example wherein under such unfavorable launch conditions the air vehicle 10 would not normally be launched. Such unfavorable launch conditions can include, for example, an unstable launch platform and/or unfavorable atmospheric conditions, for example high winds. For example, such unfavorable launch conditions could apply an undesired moment to the modified air vehicle 10 at or during launch, and the RCS 100 is correspondingly operated, in a similar manner as disclosed above for each of the first integration level LV1, the second integration level LV2, and third integration level LV3, mutatis mutandis, to generate a counter control moment in an opposite direction undesired moment and of appropriate magnitude (for example similar to the magnitude of the undesired moment), to thereby stabilize the air vehicle.

In an alternative variation of the above example of the RCS 100, the communication module 270 can be omitted. Instead, the RCS controller 260 is coupled to an inertial navigation system, also comprised in the RCS 100. In such a case, the RCS 100 is operative to control activation of each micro-rocket module 300 responsive to navigational data provided by inertial navigation system. Thus, after the air vehicle 10 is launched and reached point XP, the inertial navigation system determines which of the micro-rocket modules 300 need to be fired to provide the require negative pitch, when the counter pitch needs to be applied at point FP, and when the RCS 100 can be ejected (point EP). Corresponding data is provided to the RCS controller 260 to thereby control the micro-rocket modules 300 and to eject the RCS 100.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed examples in accordance with the presently disclosed subject matter, it will be appreciated that many changes may be made therein without departing from the spirit of the presently disclosed subject matter.

The invention claimed is:

1. A reaction control system (RCS) for use with an air vehicle having a nose portion and a center of gravity aft of the nose portion, wherein the air vehicle includes a flight computer for controlling a trajectory of the air vehicle, the RCS further comprising:

a belt element configured for selectively securing the RCS to the nose portion;

a plurality of micro-rocket modules affixed to the belt element, each of said plurality of micro-rocket modules being configured for being selectively activated to provide corresponding control moments to the air vehicle when secured to the nose portion thereof;

an RCS controller operatively connected to, and configured for controlling activation of, each of said plurality of micro-rocket modules; and a communications module operatively connected to said RCS controller and configured for providing a communication link between the RCS and the flight computer and for receiving operation commands therefrom for selectively activating each of said plurality of micro-rocket modules via said RCS controller.

2. The RCS according to claim 1, wherein the air vehicle includes a maximum diameter of the air vehicle defined aft of the nose portion, the nose portion having a nose portion diameter smaller than the maximum diameter, and wherein when secured to the nose portion, the RCS is within a cylindrical envelope not exceeding the maximum diameter.

3. The RCS according to claim 1, wherein the air vehicle includes a maximum longitudinal length of the air vehicle, and wherein when secured to the air vehicle, the RCS is within the maximum longitudinal length of the air vehicle.

4. The RCS according to claim 1, wherein said belt element is configured for selectively securing circumferentially the RCS to the nose portion.

5. The RCS according to claim 4, wherein said belt element has an inner-facing surface conformal with a portion of an outer surface of the nose portion onto which said inner facing surface abuts when the RCS is secured to the nose portion.

6. The RCS according to claim 1, wherein the belt element is in the form of an annular band.

7. The RCS according to claim 1, further configured for being selectively ejected from the air vehicle.

8. The RCS according to claim 7, wherein:

the belt element is in the form of a band including two end portions of said band;

said end portions are initially held together by a securing arrangement to enable the RCS to be secured to the nose portion; and the securing arrangement is configured for being selectively activated to thereby separate said two end portions and allow the RCS to become detached from the air vehicle.

9. The RCS according to claim 1, wherein said plurality of micro-rocket modules include four micro-rocket modules each of which is affixed to the belt element in equi-spaced relationship with respect to an adjacent said micro-rocket module.

10. The RCS according to claim 1, configured for activating at least one said plurality of micro-rocket modules under predetermined conditions to orient the air vehicle in desired orientation to the horizontal.

11. The RCS according to claim 10, wherein at least one of the following:

said predetermined conditions include a predetermined time period after launch of the air vehicle;

said predetermined conditions include a predetermined range from the launch site of the air vehicle; or said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; or 40° to 50°.

12. The RCS according to claim 1, wherein at least one of the following:

at least one said micro-rocket module comprises a solid rocket motor;

at least one said micro-rocket module comprises a compressed gas tank coupled to a nozzle;

the air vehicle includes a missile;

the air vehicle includes a rocket; or the air vehicle includes a UAV.

13. A reaction control system (RCS) for use with an air vehicle having a nose portion and a center of gravity aft of the nose portion, the RCS comprising:

a belt element configured for selectively securing the RCS to the nose portion;

a plurality of micro-rocket modules affixed to the belt element, each of said plurality of micro-rocket modules being configured for being selectively activated to provide corresponding control moments to the air vehicle when secured to the nose portion thereof;

an RCS controller operatively connected to, and configured for controlling activation of, each of said plurality of micro-rocket modules;

an inertial navigation system operatively coupled to said RCS controller; and the RCS being operative to control activation of each of said plurality of micro-rocket modules responsive to navigational data provided by said inertial navigation system.

14. The RCS according to claim 13, wherein the air vehicle includes a maximum diameter of the air vehicle defined aft of the nose portion, the nose portion having a nose portion diameter smaller than the maximum diameter, wherein when secured to the nose portion the RCS is within a cylindrical envelope not exceeding the maximum diameter.

15. The RCS according to claim 13, wherein the air vehicle includes a maximum longitudinal length of the air vehicle, wherein when secured to the air vehicle the RCS is within the maximum longitudinal length of the air vehicle.

16. The RCS according to claim 13, wherein said belt element is configured for selectively securing circumferentially the RCS to the nose portion.

17. The RCS according to claim 16, wherein said belt element has an inner-facing surface conformal with a portion of an outer surface of the nose portion onto which said inner facing surface abuts when the RCS is secured to the nose portion.

18. The RCS according to claim 13, wherein the belt element is in the form of an annular band.

19. The RCS according to claim 13, further configured for being selectively ejected from the air vehicle.

20. The RCS according to claim 19, wherein the belt element is in the form of a band including two end portions of said band, and wherein said end portions are initially held together by a securing arrangement to enable the RCS to be secured to the nose portion, and wherein the securing arrangement is configured for being selectively activated to thereby separate said two end portions and allow the RCS to become detached from the air vehicle.

21. The RCS according to claim 13, wherein the plurality of micro-rocket modules includes four said micro-rocket modules, each of said plurality of micro-rocket modules being affixed to the belt element in equi-spaced relationship with respect to an adjacent said micro-rocket module.

22. The RCS according to claim 13, configured for activating at least one said micro-rocket module under predetermined conditions to orient the air vehicle in desired orientation to the horizontal.

23. The RCS according to claim 22, including at least one of the following:

wherein said predetermined conditions include a predetermined time period after launch of the air vehicle;

wherein said predetermined conditions include a predetermined range from the launch site of the air vehicle; or wherein said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; 40° to 50°.

24. The RCS according to claim 13, including at least one of the following:

wherein at least one said micro-rocket module comprises a solid rocket motor;

wherein at least one said micro-rocket module comprises a compressed gas tank coupled to a nozzle;

wherein the air vehicle is a missile;

wherein the air vehicle is a rocket; or wherein the air vehicle is a UAV.

25. An air vehicle having a nose portion and a center of gravity aft of the nose portion, the air vehicle including a flight computer for controlling a trajectory of the air vehicle, the air vehicle comprising:

a reaction control system (RCS), the RCS comprising:

a belt element configured for selectively securing the RCS to the nose portion; and a plurality of micro-rocket modules affixed to the belt element, each of said plurality of micro-rocket modules being configured for being selectively activated to provide corresponding control moments to the air vehicle when secured to the nose portion thereof;

an RCS controller operatively connected to, and configured for controlling activation of, each said micro-rocket module; and a communications module operatively connected to said RCS controller and configured for providing a communication link between the RCS and the flight computer and for receiving operation commands therefrom for selectively activating each of said plurality of micro-rocket modules via said RCS controller.

26. The air vehicle according to claim 25, further comprising a propulsion unit for providing a forward thrust to the air vehicle.

27. A method for modifying an air vehicle, the method comprising:

providing the air vehicle, the air vehicle having a nose portion and a center of gravity aft of the nose portion, and a flight computer for controlling a trajectory of the air vehicle;

providing a reaction control system (RCS) comprising:

a belt element configured for selectively securing the RCS to the nose portion; and a plurality of micro-rocket modules affixed to the belt element, each of said plurality of micro-rocket modules being configured for being selectively activated to provide corresponding control moments to the air vehicle when secured to the nose portion thereof;

providing:

an RCS controller operatively connected to, and configured for controlling activation of, each said micro-rocket module; and a communications module operatively connected to said RCS controller and configured for providing a communication link between the RCS and the flight computer and for receiving operation commands therefrom for selectively activating each of said plurality of micro-rocket modules via said RCS controller selectively securing the RCS to the nose portion.

28. The method according to claim 27, further comprising selectively activating at least one of said plurality of micro-rocket modules to provide a control moment to the air vehicle under predetermined conditions to orient the air vehicle in a desired orientation to the horizontal.

29. The method according to claim 28, wherein at least one of the following:

said predetermined conditions include a predetermined time period after launch of the air vehicle;

said predetermined conditions include a predetermined range from the launch site of the air vehicle;

said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; or 40° to 50°.

30. The method according to claim 27, further comprising selectively activating at least one of said plurality of micro-rocket modules to provide a control moment to the air vehicle under predetermined conditions to counter an undesired moment being externally applied thereto.

31. The method according to claim 30, at least one of the following:

wherein said predetermined conditions include unfavorable launch conditions; or wherein said undesired moment is being applied by wind acting on the air vehicle during launch.

32. An air vehicle having a nose portion and a center of gravity aft of the nose portion, and comprising a reaction control system (RCS), the RCS comprising:

a belt element configured for selectively securing the RCS to the nose portion;

a plurality of micro-rocket modules affixed to the belt element, each said micro-rocket module being configured for being selectively activated to provide corresponding control moments to the air vehicle when secured to the nose portion thereof;

an RCS controller operatively connected to, and configured for controlling activation of, each of said plurality of micro-rocket modules;

an inertial navigation system operatively coupled to said RCS controller;

the RCS being operative to control activation of each of said plurality of micro-rocket modules responsive to navigational data provided by said inertial navigation system.

33. A method for modifying an air vehicle, the method comprising:

providing the air vehicle, the air vehicle having a nose portion and a center of gravity aft of the nose portion;

providing a reaction control system (RCS) comprising:

a belt element configured for selectively securing the RCS to the nose portion;

a plurality of micro-rocket modules affixed to the belt element, each said micro-rocket module being configured for being selectively activated to provide corresponding control moments to the air vehicle when secured to the nose portion thereof;

providing:

an RCS controller operatively connected to, and configured for controlling activation of, each said micro-rocket module;

an inertial navigation system operatively coupled to said RCS controller;

the RCS being operative to control activation of each said micro-rocket module responsive to navigational data provided by said inertial navigation system;

selectively securing the RCS to the nose portion.

34. The method according to claim 33, further comprising selectively activating at least one of said plurality of micro-rocket modules to provide a control moment to the air vehicle under predetermined conditions to orient the air vehicle in a desired orientation to the horizontal.

35. The method according to claim 34, including at least one of the following:

wherein said predetermined conditions include a predetermined time period after launch of the air vehicle;

wherein said predetermined conditions include a predetermined range from the launch site of the air vehicle; or wherein said desired orientation to the horizontal is within at least one of the following ranges with respect to the horizontal: 0° to 89°; 5° to 85°; 10° to 80°; 15° to 75°; 20° to 70°; 25° to 65°; 30° to 60°; 35° to 55°; 40° to 50°.

36. The method according to claim 33, further comprising selectively activating at least one of said plurality of micro-rocket modules to provide a control moment to the air vehicle under predetermined conditions to counter an undesired moment being externally applied thereto.

37. The method according to claim 36, including at least one of the following:

wherein said predetermined conditions include unfavorable launch conditions; or wherein said undesired moment is being applied by wind acting on the air vehicle during launch.

* * * * *